US011745045B2

(12) United States Patent
Wang

(10) Patent No.: US 11,745,045 B2
(45) Date of Patent: Sep. 5, 2023

(54) WEIGHT ADJUSTABLE EXERCISE DEVICE

(71) Applicant: BETO ENGINEERING AND MARKETING CO., LTD., Taichung (TW)

(72) Inventor: Lopin Wang, Taichung (TW)

(73) Assignee: BETO ENGINEERING AND MARKETING CO., LTD., Taichung (TW)

( * ) Notice: Subject to any disclaimer, the term of this patent is extended or adjusted under 35 U.S.C. 154(b) by 98 days.

(21) Appl. No.: 17/478,171

(22) Filed: Sep. 17, 2021

(65) Prior Publication Data

US 2022/0088432 A1 Mar. 24, 2022

(30) Foreign Application Priority Data

Sep. 24, 2020 (TW) ..... 109133133

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ... A63B 21/00058–00065; A63B 21/072–075; A63B 71/0036
See application file for complete search history.

(56) References Cited

U.S. PATENT DOCUMENTS

| | | | | |
|---|---|---|---|---|
| 7,549,952 | B2 * | 6/2009 | Towley, III | A63B 21/075 482/106 |
| 8,932,188 | B2 * | 1/2015 | Svenberg | A63B 21/0728 482/106 |
| 9,126,072 | B2 * | 9/2015 | Watterson | A63B 21/0726 |
| 9,795,822 | B2 * | 10/2017 | Smith | A63B 24/0087 |
| 10,065,064 | B2 * | 9/2018 | Smith | A63B 21/0722 |
| 10,071,285 | B2 * | 9/2018 | Smith | A63B 24/0087 |
| 10,195,477 | B2 * | 2/2019 | Marjama | A63B 21/0728 |
| 10,617,905 | B2 * | 4/2020 | Moran | A63B 71/0619 |
| 10,974,093 | B2 * | 4/2021 | Wang | A63B 24/0087 |
| 2022/0249898 | A1 * | 8/2022 | Jiang | A63B 21/0728 |
| 2023/0025915 | A1 * | 1/2023 | Tracy | F16M 11/043 |

* cited by examiner

*Primary Examiner* — Joshua Lee
*Assistant Examiner* — Kathleen M Fisk
(74) *Attorney, Agent, or Firm* — Muncy, Geissler, Olds & Lowe, P.C.

(57) ABSTRACT

A weight adjustable exercise device includes a base unit and a handle unit. Two magnetically attractive members are spacedly disposed on the base unit. Two weight sets are supported by the base unit, and respectively have a plurality of weights. The handle unit includes a handle shaft, two anti-rotation modules non-rotatably sleeved around two opposite end portions of the handle shaft and insertable downwardly in the base unit, two weight adjusting modules respectively mounted on the anti-rotation modules, and two indexing discs rotatably mounted on the weight adjusting modules. Each weight adjusting module has selector assemblies rotated with the handle shaft to selectively engage with or be disengaged from the corresponding weights. Each anti-rotation module has a magnet member removably engaged with the corresponding indexing disc and movable by a magnetically attractive force of the corresponding magnetically attractive member to be disengaged from the corresponding indexing disc.

10 Claims, 9 Drawing Sheets

WEIGHT ADJUSTABLE EXERCISE DEVICE

CROSS-REFERENCE TO RELATED APPLICATION

This application claims priority of Taiwanese Patent Application No. 109133133, filed on Sep. 24, 2020.

FIELD

The disclosure relates to a weight adjustable exercise device, and more particularly to an adjustable dumbbell device that includes weights adjustably attachable to two ends of a handle.

BACKGROUND

A conventional adjustable dumbbell device includes an adjustable dumbbell and a base. To change the weight of the dumbbell, the dumbbell is placed in the base, a handle thereof is turned to engage a desired combination of weights, and is then removed from the base to perform a desired exercise. The desired combination of weights are coupled to the handle and unused weights remain in the base. Two anti-rotation units are disposed at two ends of the handle to hold the weights and have them not rotated relative to the handle during use of the dumbbell so as to prevent undesired removal of the weights from the handle, and are driven by releasing members disposed on the base when the dumbbell is placed in the base so as to unlock the anti-rotation units to permit transmission of rotation of the handle. However, the releasing members are in frictional engagement with the anti-rotation units to perform an unlocking operation, which is liable to wearing and deformation during a long term use and results in malfunction of the anti-rotation units.

SUMMARY

Therefore, an object of the disclosure is to provide a weight adjustable exercise device that can alleviate at least one of the drawbacks of the prior art.

According to the disclosure, the weight adjustable exercise device includes a base unit, a magnetically attractive unit, a weight unit and a handle unit. The magnetically attractive unit includes two magnetically attractive members which are disposed on the base unit and spaced apart from each other. The weight unit includes two weight sets which are supported by the base unit and spaced apart from each other in a left-right direction. Each of the weight sets has a plurality of weights which are supported on the base unit to be held upright and spaced apart from each other in the left-right direction. The handle unit includes a handle shaft which extends in the left-right direction to have two opposite end portions, two anti-rotation modules which are respectively and non-rotatably sleeved around the opposite end portions of the handle shaft and which are insertable downwardly in and supported on the base unit, two weight adjusting modules which are respectively mounted on the anti-rotation modules, and two indexing discs which are respectively and rotatably mounted on the weight adjusting modules. Each of the weight adjusting modules has a plurality of selector assemblies which are securely sleeved on the handle shaft and respectively aligned with corresponding ones of the weights. The selector assemblies of each of the weight adjusting modules and a corresponding one of the indexing discs are rotatable synchronously such that each of the selector assemblies selectively engages or is disengaged from the corresponding one of the weights. Each of the anti-rotation modules has a mounting seat which is insertable downwardly in the base unit, and a magnet member which is movably mounted on the mounting seat to be removably engaged with the corresponding one of the indexing discs. The magnet member is movable by a magnetically attractive force of a corresponding one of the magnetically attractive members to be disengaged from the corresponding one of the indexing discs when the mounting seat is insertable downwardly in the base unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
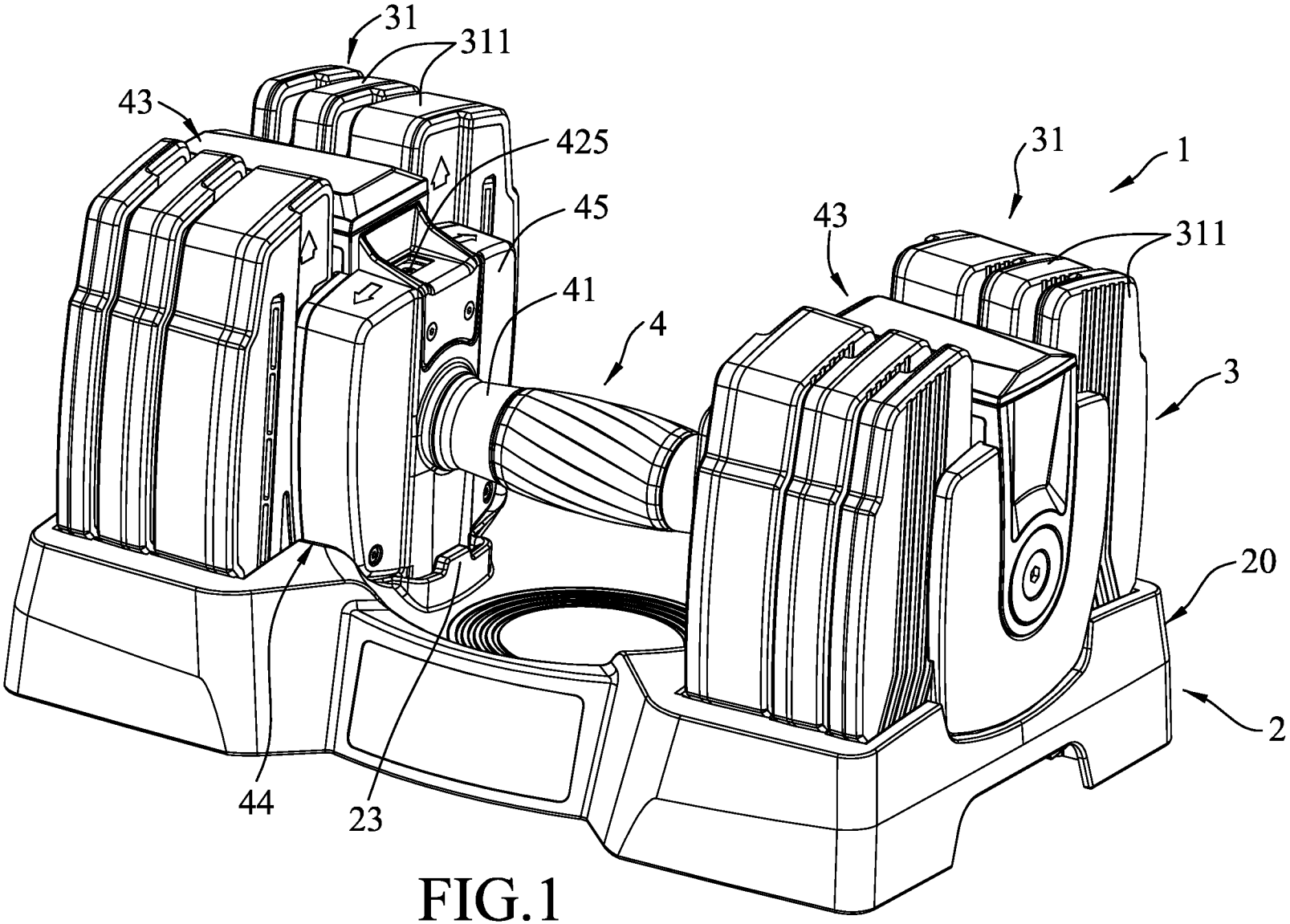
FIG. 1 is a perspective view illustrating an embodiment of a weight adjustable exercise device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
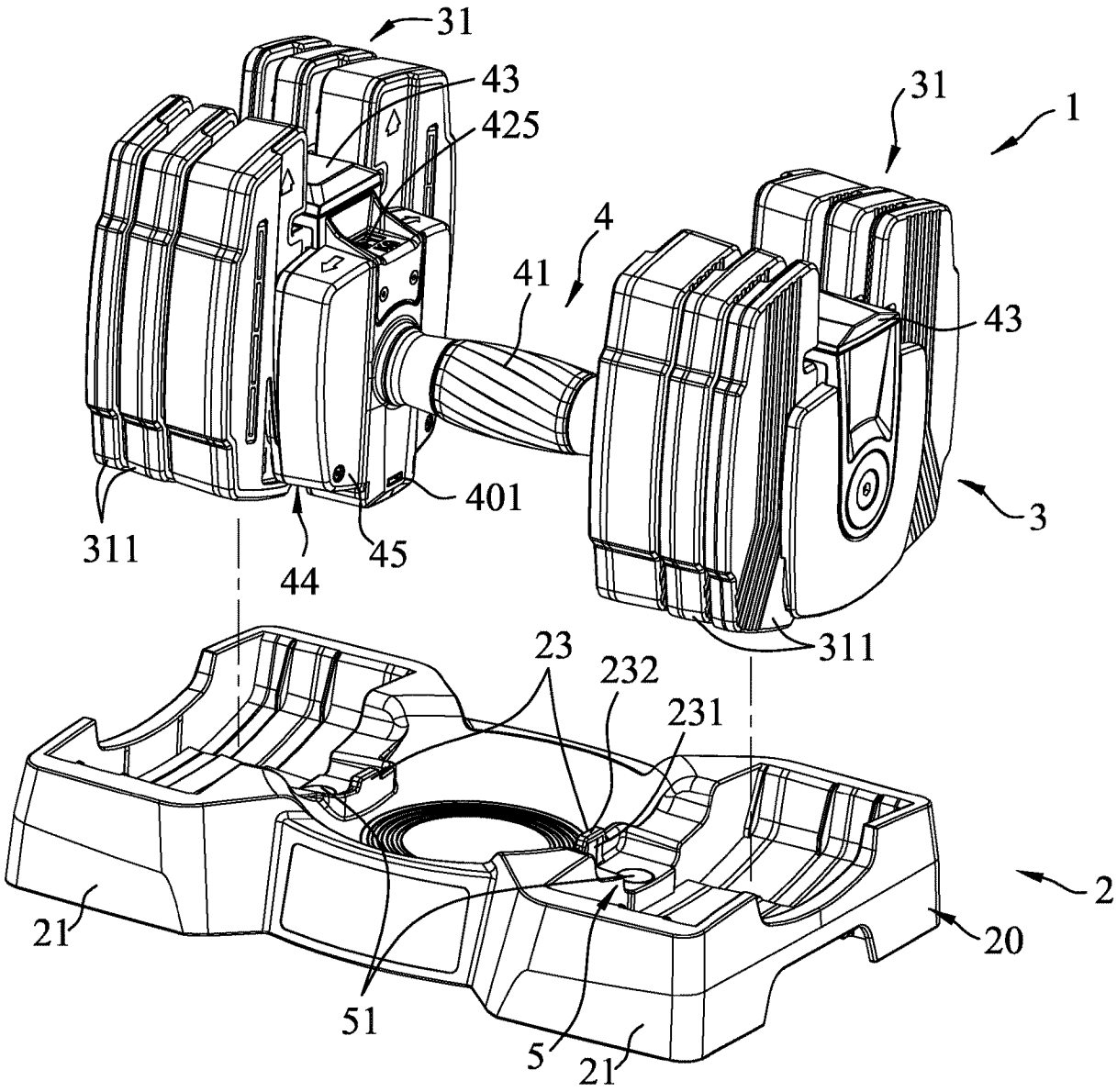
FIG. 2 is a partially exploded, perspective view of the embodiment of FIG. 1.

Referring to FIGS. 1 and 2, an embodiment of a weight adjustable exercise device 1 according to the disclosure includes a base unit 2, a magnetically attractive unit 5, a weight unit 3 and a handle unit 4.

The base unit 2 includes a base 20 having two cradle parts 21 which are spaced apart from each other in a left-right direction for respectively receiving two weight sets 31 of the weight unit 3. Each weight set 31 has a plurality of weights 311 which are supported on the respective cradle part 21 to be held upright and spaced apart from each other in the left-right direction. Each weight 311 has two engaging holes (not shown) facing each other in a front-rear direction transverse to the left-right direction.

The magnetically attractive unit 5 includes two magnetically attractive members 51 which are disposed on the cradle parts 21, respectively.

The base unit 2 further includes two locking members 23 which are respectively disposed on the cradle parts 21 and inboard of and adjacent to the magnetically attractive members 51, respectively. Each locking member 23 has a vertical portion 231 which extends upwardly from the respective cradle part 21, and a horizontal portion 232 which extends perpendicular from an end of the vertical portion 231 that is distal from the cradle part 21.

Figure 3:
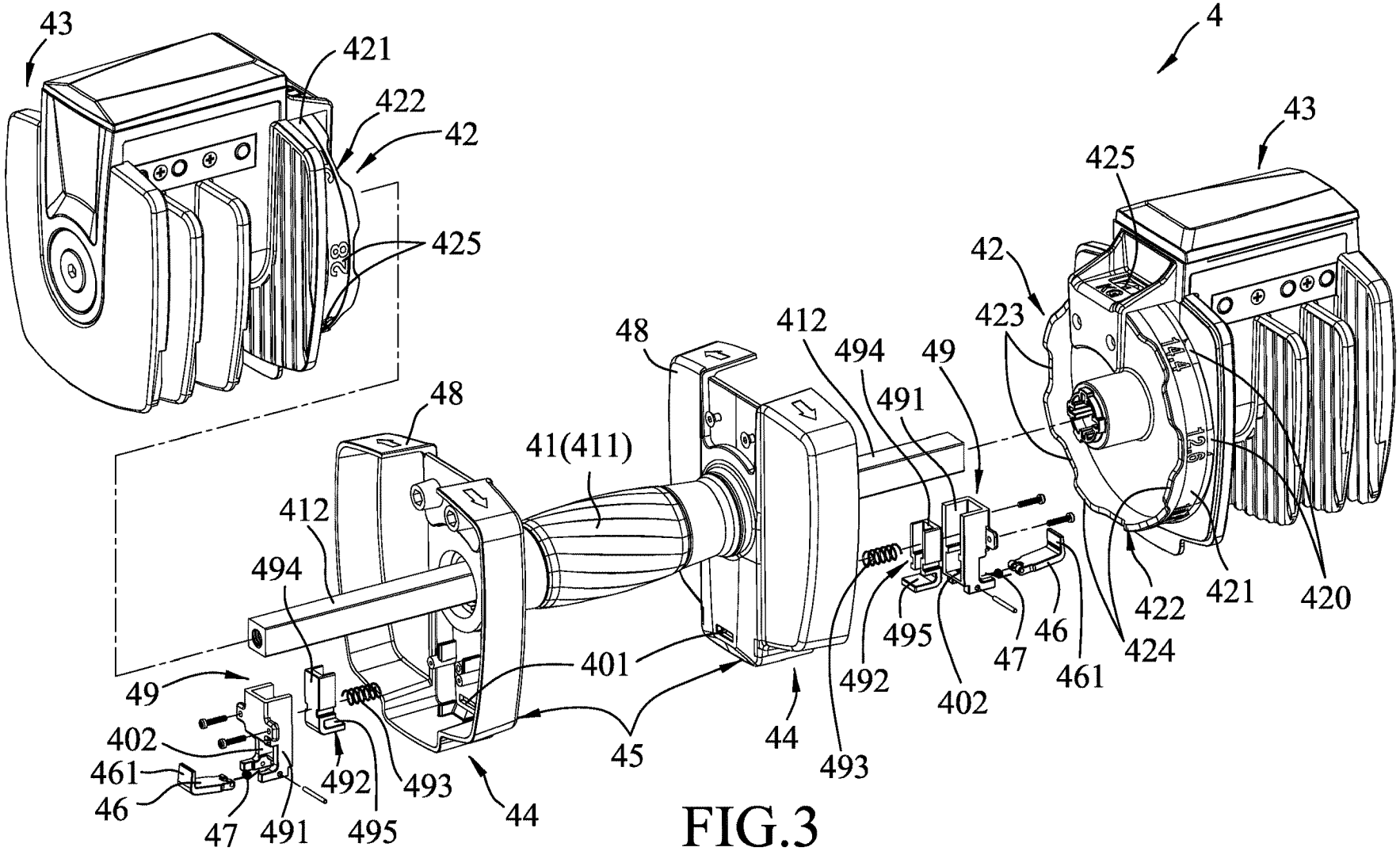
FIG. 3 is an exploded perspective view of a handle unit of the embodiment of FIG. 1.
Figure 4:
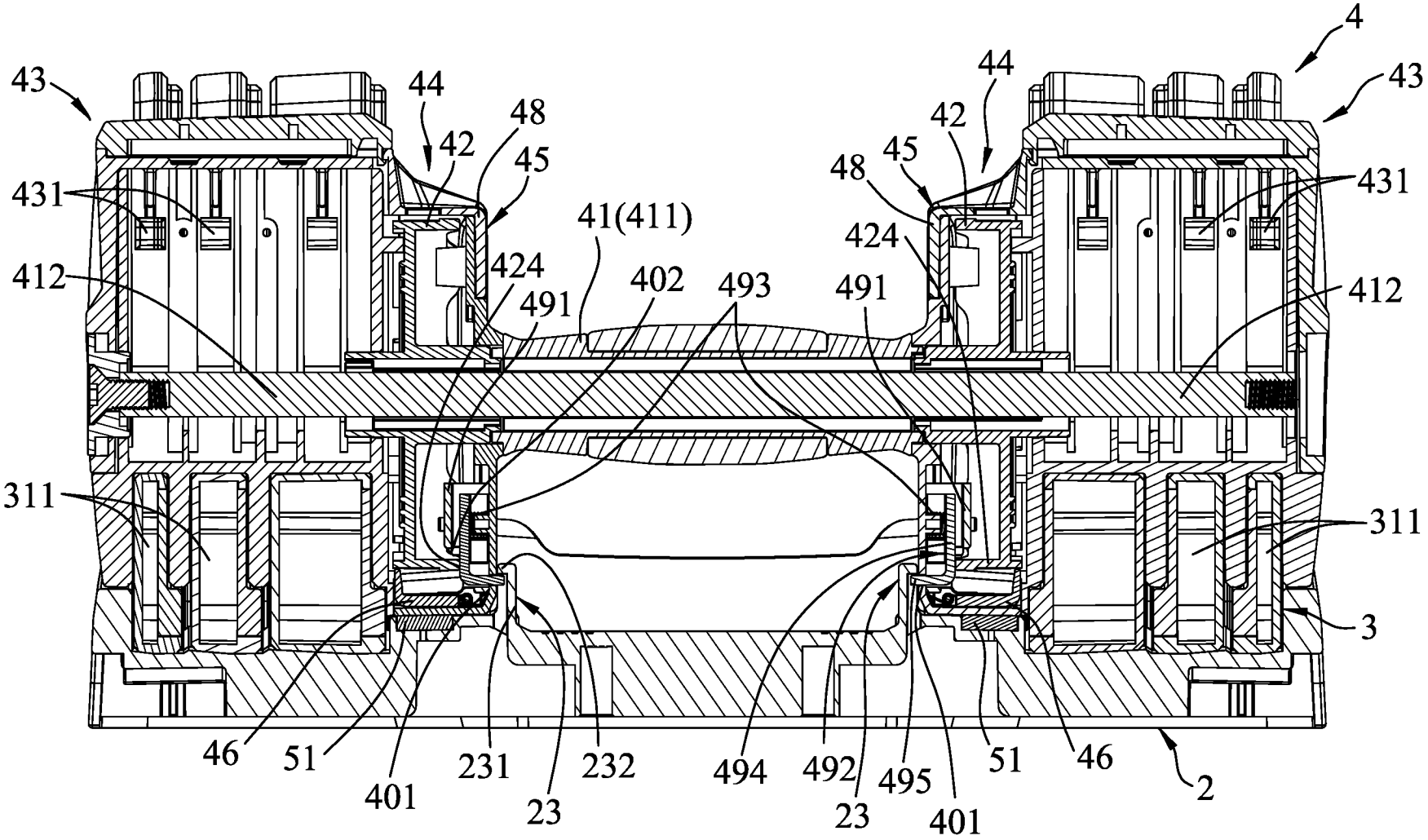
FIG. 4 is a sectional view of the embodiment, illustrating that two locked assemblies are in a locked state.
Figure 5:
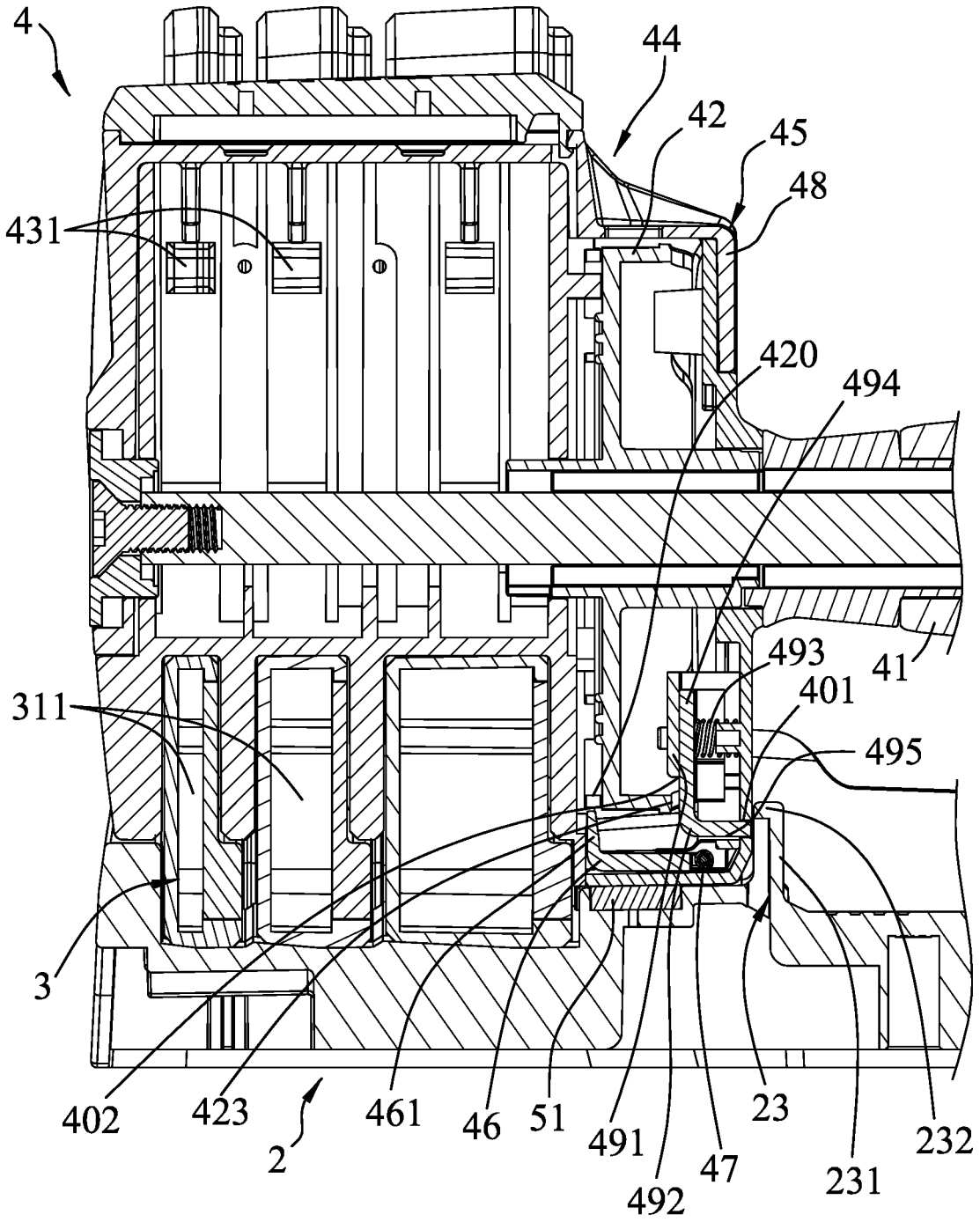
FIG. 5 is a fragmentary sectional view of the embodiment, illustrating that the locked assemblies are in a released state.

With reference to FIGS. 3 to 5, the handle unit 4 includes a handle shaft 41 which extends in the left-right direction to have two opposite end portions 412, two anti-rotation modules 44 which are respectively and non-rotatably sleeved around the opposite end portions 412 of the handle shaft 41 and which are insertable downwardly in and supported on the cradle parts 21, respectively, two weight adjusting modules 43 which are respectively mounted on the anti-rotation modules 44, and two indexing discs 42 which are respectively and rotatably mounted on the weight adjusting modules 43. The two weight sets 31 may be coupled to the handle unit 4 to cooperatively form a dumbbell.

Each of the weight adjusting modules 43 has a plurality of selector assemblies 431 which are securely sleeved on the handle shaft 41 and respectively aligned with corresponding ones of the weights 311, With the rotation of the handle shaft 41, each selector assembly 431 selectively engages or is disengaged from the engaging holes of the corresponding weight 311. Since the selector assemblies 431 engaging with or disengaged from the weights 311 are not the main aspect of this disclosure, a detailed description thereof is omitted herein. The selector assemblies 431 and the weights 311 are disclosed in U.S. Pat. No. 11,040,235, which is hereby incorporated by reference. The selector assemblies 431 of each weight adjusting module 43 and the corresponding indexing disc 42 are rotatable synchronously.

Each of the indexing discs 42 has a surrounding end surface 422 which faces a grip portion 411 of the handle shaft 41 in the eft-right direction, and a plurality of insert holes 420 which are formed in an outer peripheral wall 421 thereof and angularly spaced apart from each other. The surrounding end surface 422 has a plurality of concaved sections 423 and a plurality of convex sections 424 which are angularly spaced apart from each other and alternately arranged therearound. The insert holes 420 are respectively aligned with the concaved sections 423 in the left-right direction. Weight indicating markings 425 are formed on the outer peripheral wall 421 of each indexing disc 42.

Each of the anti-rotation modules 44 has a mounting seat 45 insertable downwardly in the respective cradle part 21, a magnet member 46 which is movably mounted on the mounting seat 45, a first spring 47, and a locked assembly 49. The mounting seat 45 has a housing 48 for receiving the corresponding weight adjusting module 43 and the indexing disc 42 therein. The housing 48 has a through hole 401 which extends therethrough in the left-right direction. The user may observe the weight indicating marking 425 exposed from the housing 48, and may grasp and turn the handle shaft 41 to rotate the indexing discs 42, and to bring the selector assemblies 431 into engagement with the weights 311 that correspond with the weight indicating marking 425.

The locked assembly 49 has a mounting frame 491 which is securely mounted in the housing 48 and which has an opening 402 extending therethrough in the left-right direction, and a movable member 492 which is movably disposed on the mounting frame 491 in the left-right direction and interposed between the through hole 401 and the corresponding indexing disc 42. The movable member 492 has a vertical abutted portion 494 which is exposed from the opening 402 to abut against the end surface 422 of the indexing disc 42, and a horizontal insert portion 495 which extends from a lower end of the vertical abutted portion 494 to be aligned with the through hole 401. The locked assembly 49 further has a second spring 493 which is connected between the housing 48 and the movable member 492 to bias the horizontal insert portion 495 away from the through hole 401.

The locked assembly 49 is shiftable with the rotation of the corresponding indexing disc 42 between a locked state and a released state. In the locked state, a selected one of the convex sections 424 of the indexing disc 42 abuts against and forces the vertical abutted portion 494 of the movable member 492, the second spring 493 is compressed, and the horizontal insert portion 495 projects through the through hole 401 to be retained with the corresponding locking member 23 in a locking condition. The horizontal insert portion 495 horizontally abuts against the vertical portion 231, and is restricted by the horizontal portion 232 from an upward movement so as to prevent upward lift of the handle unit 4. In the released state, a selected one of the concave sections 423 faces and abuts against the vertical abutted portion 494, and the movable member 492 is moved by the biasing action of the second spring 493 to retreat the horizontal insert portion 495 in the through hole 401 for the same to be disengaged from the corresponding locking member 23 in an unlocking condition so as to permit upward lift of the handle unit 4.

The magnet member 46 of each anti-rotation module 44 is pivotally connected to the mounting frame 491 to have a free end 461 which is turnable uprightly to be removably inserted into a selected one of the insert holes 420 of the corresponding indexing disc 42. When the mounting seat 45 is inserted in the base unit 2, the magnet member 46 is moved by a magnetically attractive force of the corresponding magnetically attractive member 51 to be disengaged from the corresponding indexing disc 42. The first spring 47 is in the form of a torsion spring and is connected between the magnet member 46 and the mounting frame 491 to bias the magnet member 46 upwardly for the same to be inserted in the selected insert hole 420.

To adjust the weight of the dumbbell, the user may place the dumbbell in the base unit 2 such that the anti-rotation modules 44 are disposed closer to the magnetically attractive members 51, respectively, and the magnet members 46 are moved downwardly with the magnetically attractive force to be disengaged from the insert holes 420. At this phase, the user may turn the handle shaft 41 to rotate the indexing discs 42 relative to the anti-rotation modules 44 to bring the selector assemblies 431 into engagement with the corresponding weights 311 so as to engage a desired combination of weights 311.

The user may observe the exposed weight indicating marking 425 to determine if the handle shaft 41 has been rotated to a desired position, where the selected concave section 423 of each indexing disc 42 faces and abuts against the vertical abutted portion 494 to shift each locked assembly 49 to the released state. Hence, the user may lift the dumbbell from the base unit 2. Once the handle shaft 41 is not rotated to a desired correct position, where the convex section 424 still abuts against and forces the corresponding locked assembly 49 to the locked state, the lifting and removal of the dumbbell from the base unit 2 is prevented.

Figure 6:
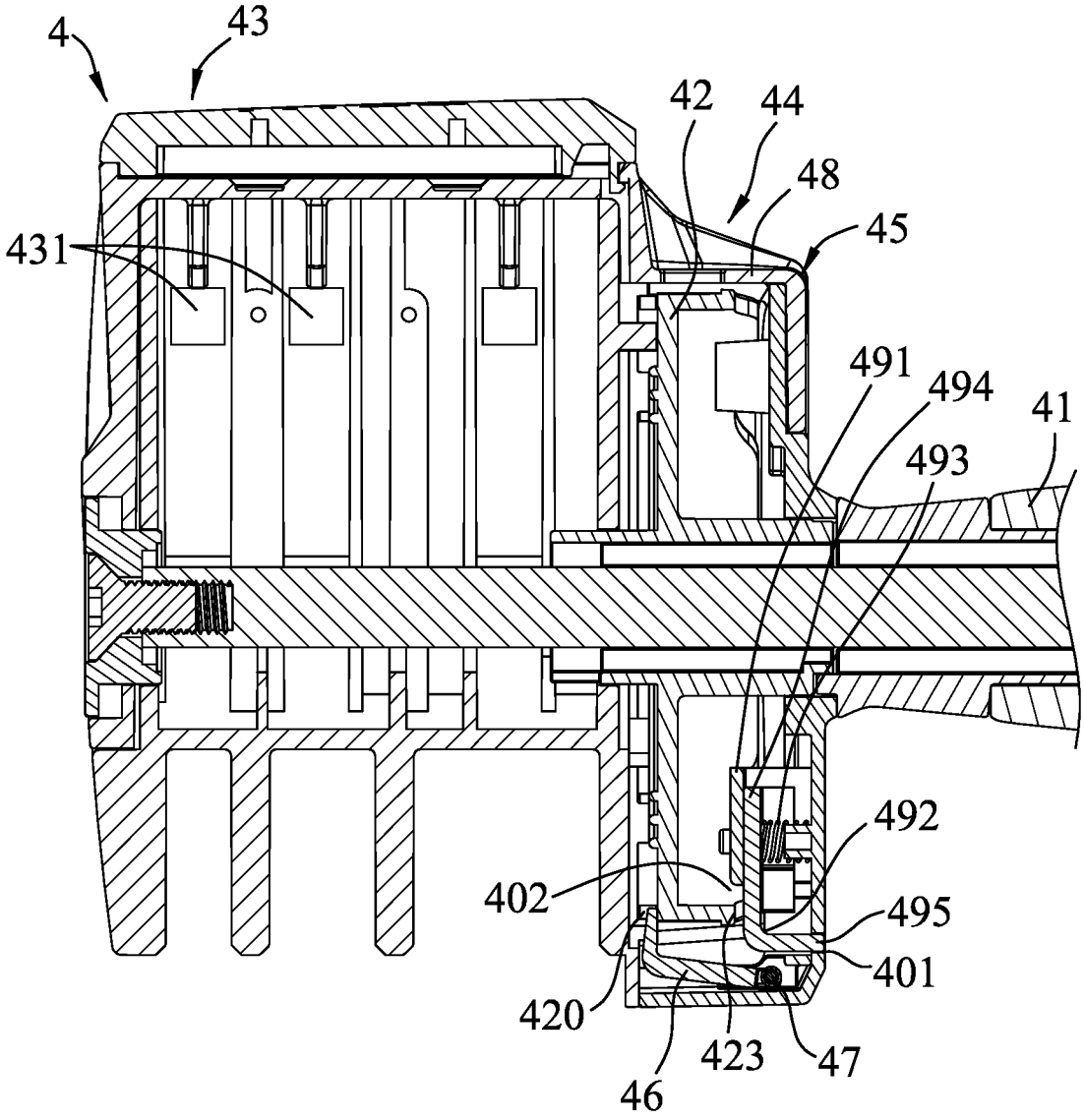
FIG. 6 is a fragmentary sectional view of the embodiment, illustrating that a magnet member is engaged in an insert hole of an indexing disc.

With reference to FIG. 6, when the handle unit 4 is lifted and removed from the base unit 2, each magnet member 46 is remote from the corresponding magnetically attractive member 51 and is moved upwardly by the biasing action of the first spring 47 to be inserted into the selected insert hole 420 of the corresponding indexing disc 42 so as to prevent rotation of the handle shaft 41 relative to the anti-rotation modules 44. Thus, occurrence of an accident that the weights 311 carried on the handle unit 4 fall due to inadvertent rotation of the handle shaft 41 to cause disengagement of the selector assemblies 431 from the engaging holes of the weights 311 can be prevented.

Figure 7:
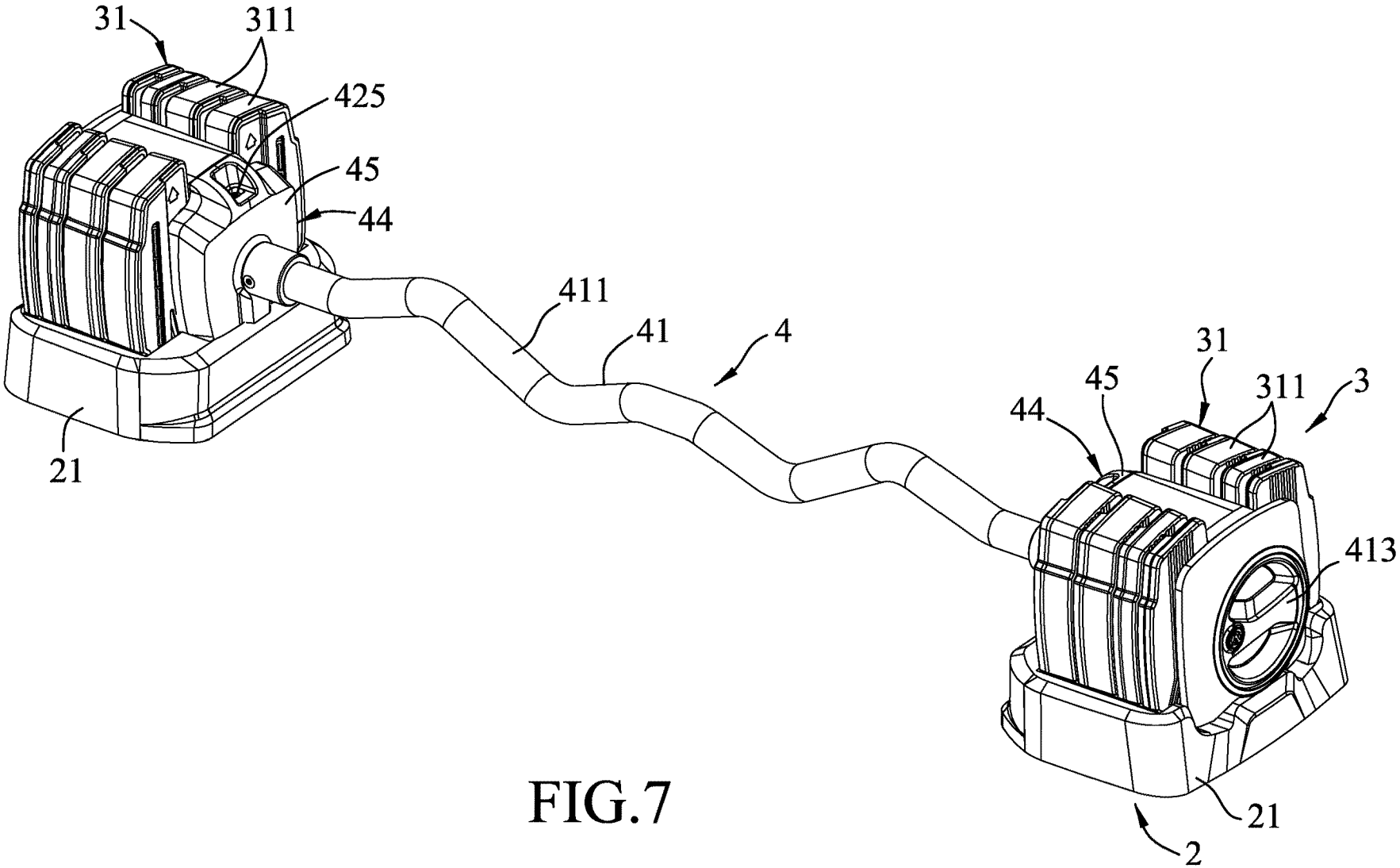
FIG. 7 is a perspective view illustrating another embodiment of the weight adjustable exercise device according to the disclosure.
Figure 8:
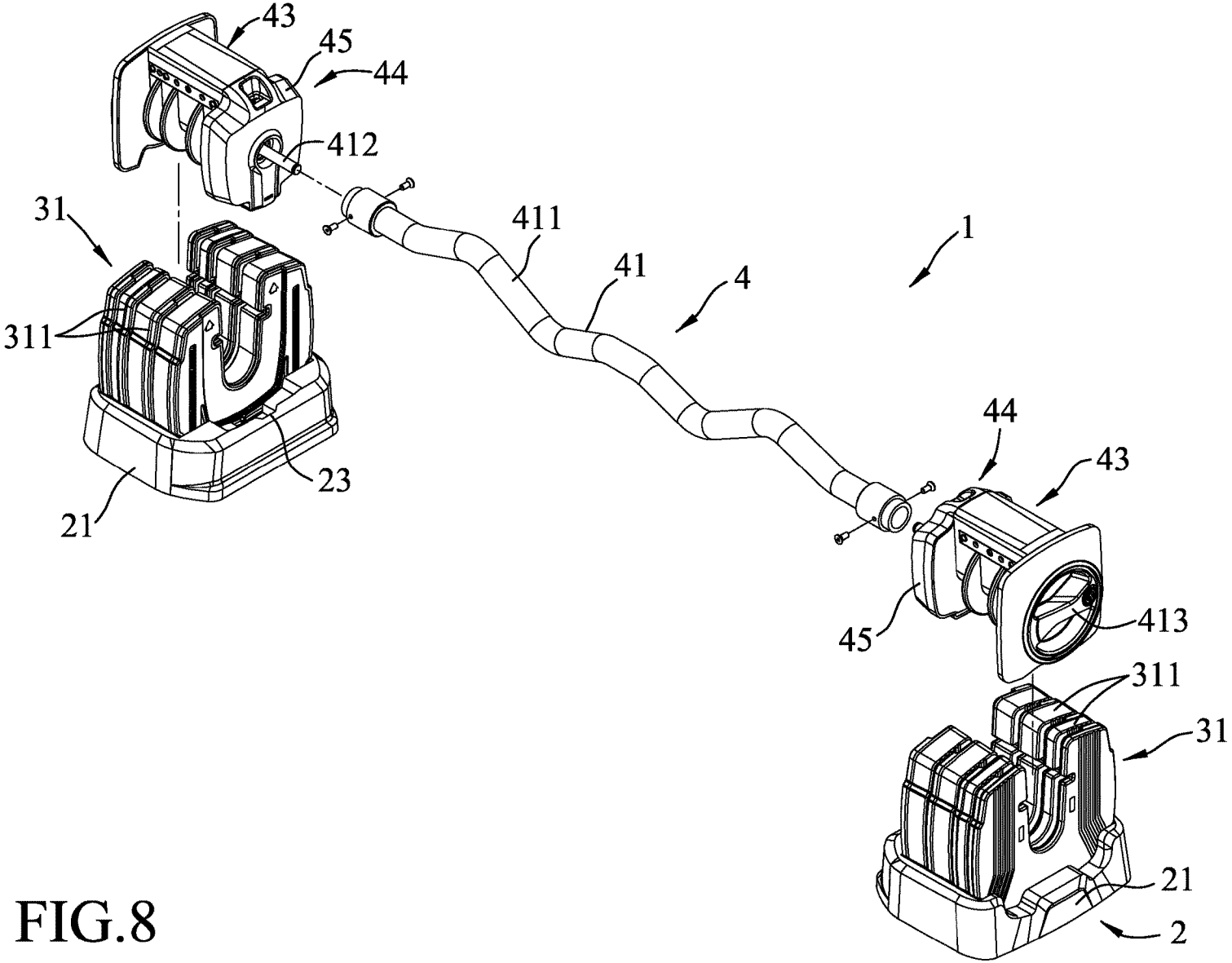
FIG. 8 is a partially exploded, perspective view of the embodiment of FIG. 7.
Figure 9:
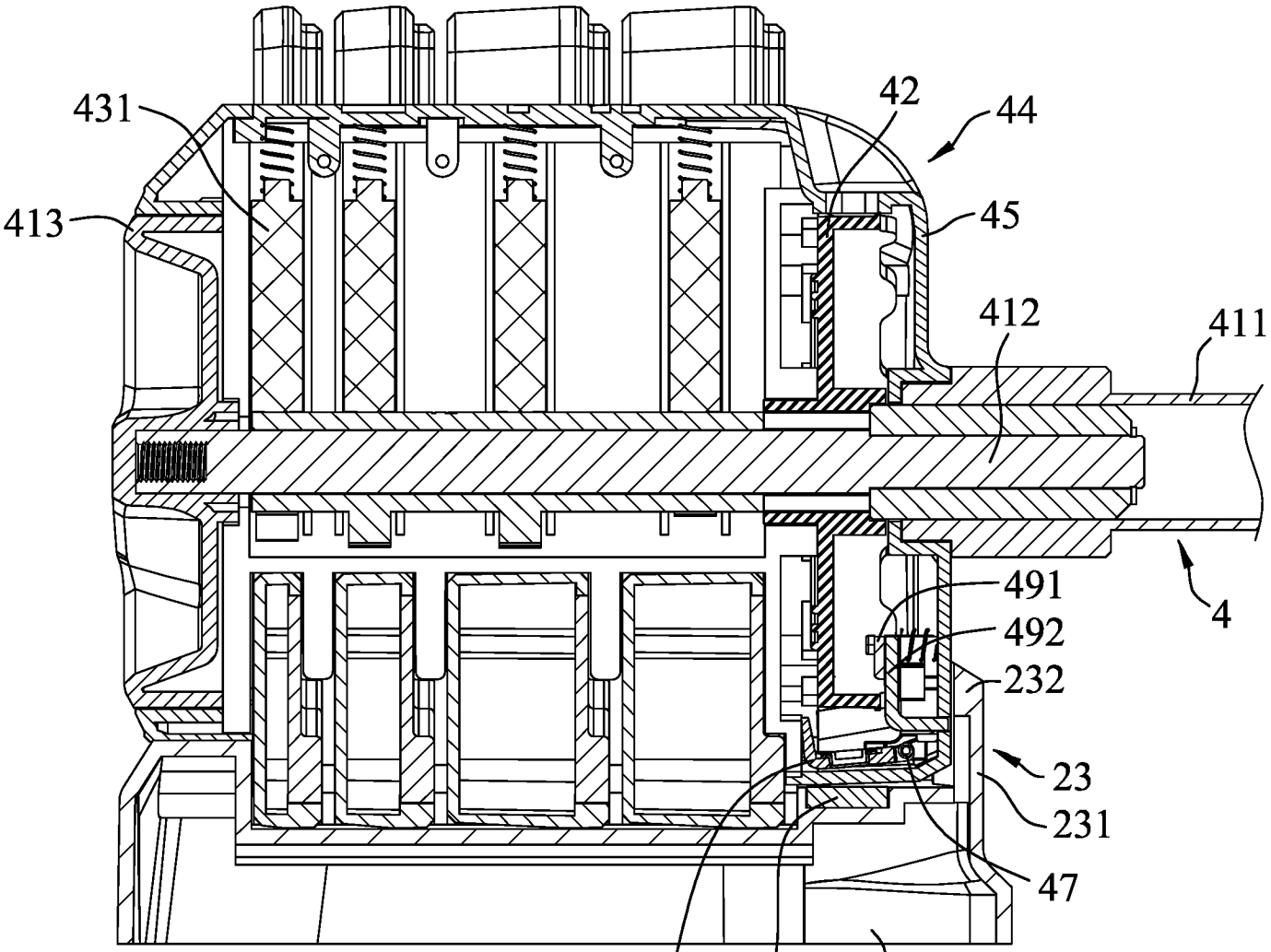
FIG. 9 is a fragmentary sectional view of the embodiment of FIG. 7.

With reference to FIGS. 7 to 9, in another embodiment, the base unit 2 includes two cradle parts 21 in the forms of two separate cradles 21. The two magnetically attractive members 51, the two weight sets 31 and the two locking members 23 are disposed on the cradles 21, respectively. The handle shaft 41 has the grip portion 411 positioned between the anti-rotation modules 44, and the opposite end portions 412 rotatably connected with the grip portion 411 to be adjusted with the weight adjusting modules 43, respectively. The handle unit 4 further includes two rotary knobs 413 which are disposed outboard of the weight adjusting modules 43, respectively, and which are respectively connected with the opposite end portions 412. Each of the opposite end portions 412 is rotatable with an operation of the corresponding rotary knob 413 to drive the rotation of each selector assembly 431 of the corresponding weight adjusting module 43 to bring the selector assemblies 431 into engagement with or disengagement from the corresponding weights 311, and to bring the indexing discs 42 to rotate in coaxial, respectively.

To change the weight of the dumbbell of this embodiment, the handle unit 4 is placed in the base unit 2 such that the anti-rotation modules 44 are disposed closer to the magnetically attractive members 51, respectively, and the magnet members 46 are moved downwardly with the magnetically attractive force of the magnetically attractive members 51 to be disengaged from the insert holes 420. The user may turn the rotary knobs 413 to rotate the opposite end portions 412 and the indexing discs 42 relative to the anti-rotation modules 44 to bring the selector assemblies 431 into engagement with the corresponding weights 311 so as to engage a desired combination of weights 311.

As illustrated, with the magnet members 46 and the magnetically attractive members 51 for permitting or preventing the rotation of the selector assemblies 431, occurrence of an accident that the weights 311 carried on the handle unit 4 fall during use of the dumbbell can be prevented. Since the magnet members 46 are movable by the magnetically attractive force of the magnetically attractive members 51 and may not physically contact with the magnetically attractive members 51, wearing and deformation of the magnetically attractive members 51 are obviated. Additionally, with the locked assemblies 49, it is impossible to lift the handle unit 4 from the base unit 2 when the selector assemblies 431 are not rotated in a correct position (i.e. the locked assemblies 49 serve as an error-proofing mechanism), which improves safety of use and reduces wearing of the component parts and cost of maintenance.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A weight adjustable exercise device comprising:

a base unit;

a magnetically attractive unit including two magnetically attractive members which are disposed on said base unit and spaced apart from each other;

a weight unit including two weight sets which are supported by said base unit and spaced apart from each other in the left-right direction, each of said weight sets having a plurality of weights which are supported on said base unit to be held upright and spaced apart from each other in a left-right direction; and a handle unit including a handle shaft which extends in the left-right direction to have two opposite end portions, two anti-rotation modules which are respectively and non-rotatably sleeved around said opposite end portions of said handle shaft and which are insertable downwardly in and supported on said base unit, two weight adjusting modules which are respectively mounted on said anti-rotation modules, and two indexing discs which are respectively and rotatably mounted on said weight adjusting modules, each of said weight adjusting modules having a plurality of selector assemblies which are securely sleeved on said handle shaft and respectively aligned with corresponding ones of said plurality of weights of said weight sets, said plurality of selector assemblies of each of said weight adjusting modules and a corresponding one of said indexing discs being rotatable synchronously such that each of said plurality of selector assemblies selectively engages or is disengaged from the corresponding one of said plurality of weights, each of said anti-rotation modules having a mounting seat which is insertable downwardly in said base unit and a magnet member which is movably mounted on said mounting seat to be removably engaged with the corresponding one of said indexing discs, said magnet member being movable by a magnetically attractive force of a corresponding one of said magnetically attractive members to be disengaged from the corresponding one of said indexing discs when said mounting seat is inserted downwardly in said base unit.

2. The weight adjustable exercise device as claimed in claim 1, wherein said opposite end portions of said handle shaft extend in the left-right direction and are inserted respectively in said weight adjusting modules, and are operable to drive said plurality of selector assemblies of each weight adjusting module into engagement with or disengagement from said corresponding plurality of weights, and bring said indexing discs to rotate in coaxial to said opposite end portions of said handle shaft.

3. The weight adjustable exercise device as claimed in claim 2, wherein said base unit includes a base on which said magnetically attractive unit is disposed, and two locking members which are disposed on said base and spaced apart from each other, said mounting seat of each of said anti-rotation modules having a housing for receiving the respective one of said weight adjusting modules therein, said housing having a through hole which extends therethrough in the left-right direction, each of said anti-rotation modules further having a locked assembly which is mounted in said housing and abuts against said corresponding one of said indexing discs to be shiftable with the rotation of said corresponding indexing disc between a locked state and a released state, wherein, in the locked state, said locked assembly projects through said through hole to be retained with a corresponding one of said locking members in a locking condition, and in the released state, said locked assembly is retreated in said through hole to be disengaged from said corresponding locking member in an unlocking condition.

4. The weight adjustable exercise device as claimed in claim 3, wherein said locked assembly of each of said anti-rotation modules has a mounting frame which is securely mounted in said housing and which has an opening extending therethrough, and a movable member which is movably disposed in said mounting frame and interposed between said through hole and said corresponding indexing disc and which is exposed from said opening to abut against said corresponding indexing disc, said locked assembly of each of said anti-rotation modules further having a spring which is connected between said housing and said movable member to bias said movable member away from said through hole, said magnet member of each of said anti-rotation modules being connected to said mounting frame.

5. The weight adjustable exercise device as claimed in claim 4, wherein each of said indexing discs has a surrounding end surface which faces said locked assembly of a respective one of said anti-rotation modules in the left-right direction, said surrounding end surface having a plurality of concaved sections and a plurality of convex sections which are angularly spaced apart from each other and alternately arranged therearound, said corresponding movable member abutting against said surrounding end surface to be moved with the rotation of said corresponding indexing disc in the left-right direction.

6. The weight adjustable exercise device as claimed in claim 5, wherein each of said locking members has a vertical portion which extends upwardly from said base, and a horizontal portion which extends perpendicular from an end of said vertical portion that is distal from said base, said corresponding movable member being movable to project through said through hole and abut against said horizontal portion in the locked state.

7. The weight adjustable exercise device as claimed in claim 3, wherein said base includes two cradles spaced apart from each other in the left-right direction, said magnetically attractive members, said weight sets and said locking members being disposed on said cradles, respectively.

8. The weight adjustable exercise device as claimed in claim 2, wherein each of said indexing discs has a plurality of insert holes which are formed in an outer peripheral wall thereof and angularly spaced apart from each other to permit said corresponding magnet member to be inserted upwardly in and engaged with a selected one of said plurality of insert holes.

9. The weight adjustable exercise device as claimed in claim 8, wherein each of said anti-rotation modules further has a first spring which is disposed to bias said magnet member upwardly to be inserted in the selected one of said plurality of insert holes.

10. The weight adjustable exercise device as claimed in claim 2, wherein a grip portion is formed in said handle shaft and is positioned between said anti-rotation modules, said opposite end portions being rotatably connected with said grip portion to be adjusted with said weight adjusting modules, respectively, said handle unit further including two rotary knobs which are disposed outboard of said weight adjusting modules, respectively, and which are respectively connected with said opposite end portions, each of said opposite end portions being rotatable with an operation of a corresponding one of said rotary knobs to drive said corresponding plurality of selector assemblies into engagement with or disengagement from said corresponding plurality of weights, and to bring said indexing discs to rotate in coaxial to said opposite end portions of said handle shaft.

* * * * *